US012520958B2

(12) United States Patent
Clendening

(10) Patent No.: US 12,520,958 B2
(45) Date of Patent: Jan. 13, 2026

(54) SYSTEM FOR AND METHOD OF SUSPENDING A MIRROR

(71) Applicant: SE-KURE CONTROLS, INC., Franklin Park, IL (US)

(72) Inventor: Roland Clendening, Colon, MI (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 18/110,760

(22) Filed: Feb. 16, 2023

(65) Prior Publication Data

US 2024/0277163 A1 Aug. 22, 2024

(51) Int. Cl.
*A47G 1/24* (2006.01)

(52) U.S. Cl.
CPC ..... *A47G 1/24* (2013.01)

(58) Field of Classification Search
CPC ..... A47G 1/16; A47G 1/1653; A47G 1/166; A47G 1/1666; A47G 1/18; A47G 1/24; A47G 1/02; A47G 1/04; F16M 13/027; A45D 42/16; A01M 31/025; F21V 21/008; F21V 21/116; G02B 7/1824; G02B 7/198
USPC ..... 362/426, 430; 248/489–498
See application file for complete search history.

(56) References Cited

U.S. PATENT DOCUMENTS 685,749 A * 10/1901 Davis ..... A47G 1/16 248/496
1,154,887 A * 9/1915 Rickles ..... A47G 1/16 248/908
1,633,120 A * 6/1927 Miller ..... A47G 1/24 359/860
3,127,147 A * 3/1964 Spangenberg ..... E04B 9/20 411/929.1
3,316,052 A * 4/1967 Ross ..... A47G 1/00 359/872
3,469,814 A * 9/1969 Carlson ..... A47G 1/24 359/873
3,876,080 A * 4/1975 Hultberg ..... A47G 1/1653 248/323
4,099,698 A * 7/1978 Bell ..... A47G 1/18 248/494
5,462,135 A * 10/1995 Ambler ..... A01M 31/02 182/187
5,695,279 A * 12/1997 Sonnleitner ..... F21V 21/30 362/419
7,063,427 B1 * 6/2006 Cutler ..... G02B 7/002 359/872
8,393,749 B1 * 3/2013 Daicos ..... A47G 1/04 359/865

(Continued)

FOREIGN PATENT DOCUMENTS

JP 0961699 A * 3/1997

*Primary Examiner* — Jonathan Liu
*Assistant Examiner* — Guang H Guan
(74) *Attorney, Agent, or Firm* — Wood, Phillips, Katz, Clark & Mortimer

(57) ABSTRACT

A suspended mirror system and a method of suspending a mirror. The mirror system has: a frame; a convex reflective surface on the frame; and a support system connecting between a mounting base and the frame and configured so that the frame is suspended in an operative position below a part of the mounting base. The support system has at least one elongate flexible component in a depending relationship with the part of the mounting base and under tension from a weight of the frame.

17 Claims, 3 Drawing Sheets

(56) References Cited

U.S. PATENT DOCUMENTS

| | | | | |
|---|---|---|---|---|
| 8,485,676 | B2 * | 7/2013 | McCarty, Jr. ..... | A45D 42/08 248/479 |
| 9,062,817 | B1 * | 6/2015 | Housman ..... | F16M 13/027 |
| 10,143,930 | B2 * | 12/2018 | D'Andrea ..... | F16M 11/045 |
| 2024/0277163 | A1 * | 8/2024 | Clendening ..... | A47G 1/24 |

* cited by examiner

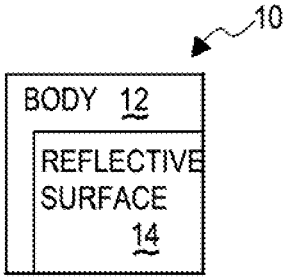
Fig. 1
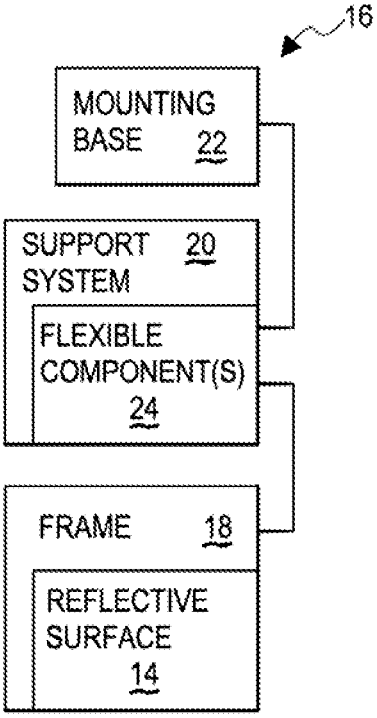
Fig. 2
Fig. 3
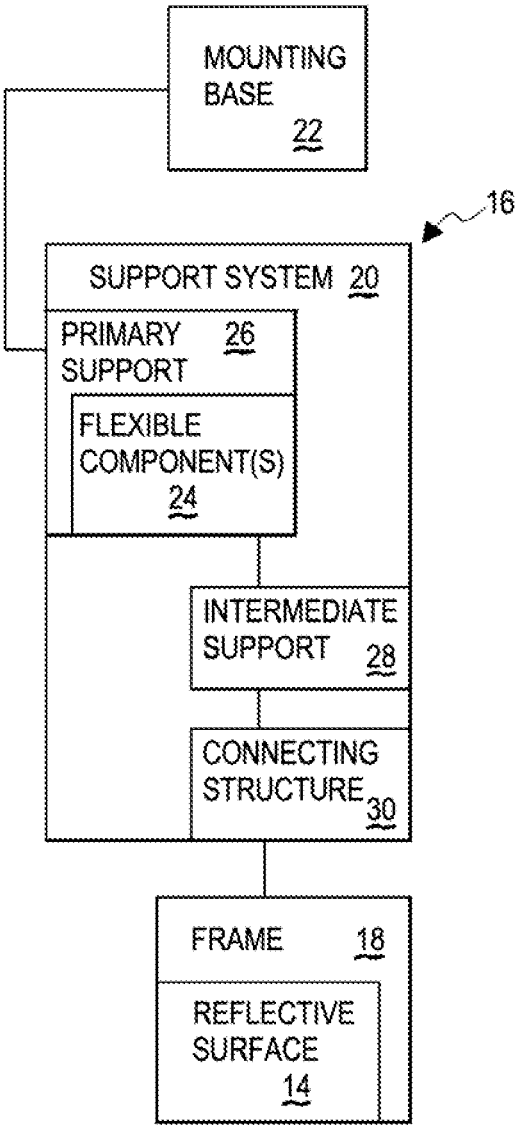
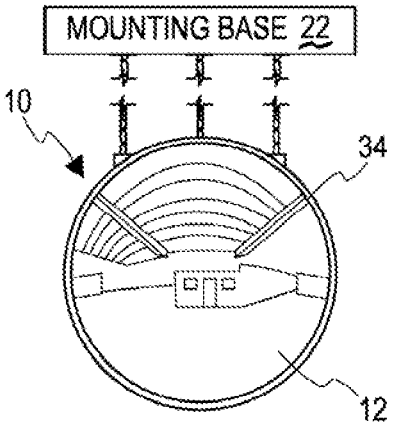
Fig. 4

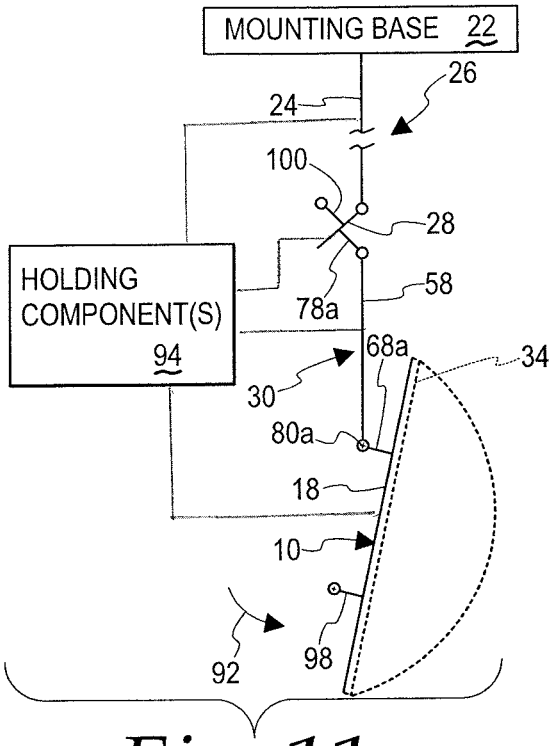
Fig. 11
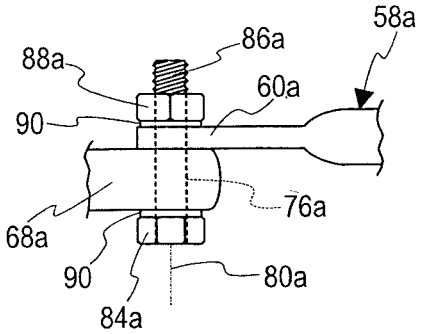
Fig. 10
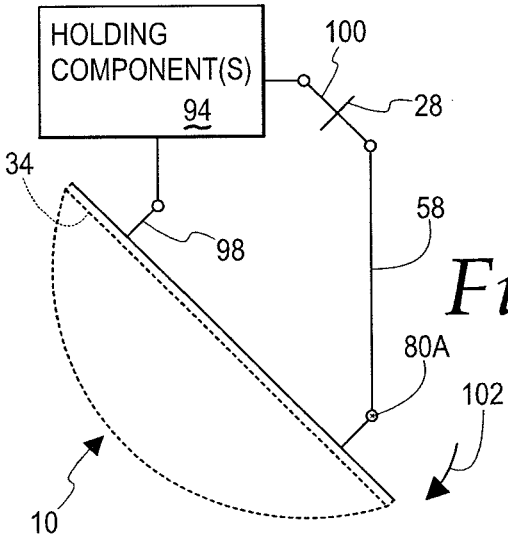
Fig. 12
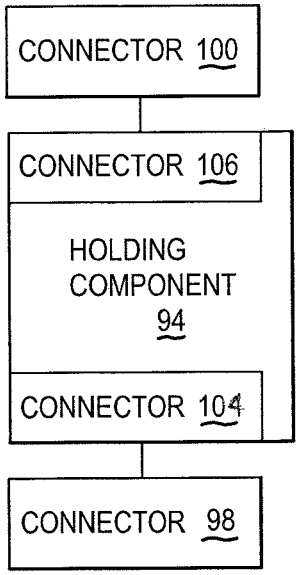
Fig. 13
Fig. 14
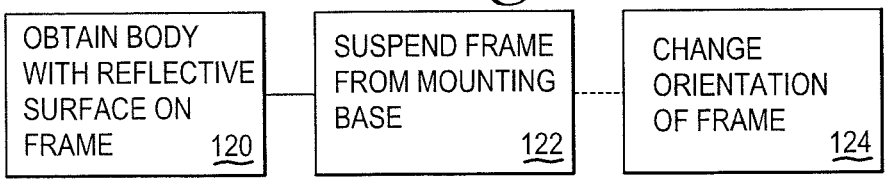

SYSTEM FOR AND METHOD OF SUSPENDING A MIRROR

BACKGROUND OF THE INVENTION

Field of the Invention

This invention relates to mirrors, such as convex mirrors, and, more particularly, to a system for, and method of, suspending a mirror in an operative position.

Background Art

Mirrors are used worldwide in many different environments to allow persons to observe areas that are not in direct line of sight. There are many reasons that mirrors are used, prime among those being safety as persons on foot and in/on vehicles maneuver in shared and intersecting routes.

As one example, manufacturing and product handling facilities commonly use strategically placed convex mirrors to eliminate blind spots at locations where it is anticipated that persons and/or vehicles will converge. A typical floor layout in these facilities will have aisles throughout designed to accommodate traffic patterns for persons walking and/or operating vehicles as they perform coordinated tasks. In large facilities, persons may share and cross routes with many others walking and operating vehicles used during manufacturing processes, while transporting completed products, etc. These regular flow patterns are coordinated also with workers, as they enter and leave individual work spaces, and supervisors that move throughout facilities.

With a large footprint, there may be a relatively complex network of travel routes that are identifiable by floor markings, shelves, walls, etc. In most facilities, these routes intersect in such a manner that care must be taken to avoid collisions. While persons are generally trained to exercise caution while navigating shared spaces, particularly at blind intersections, mirrors are commonly incorporated, recognizing that persons are often moving while distracted or while otherwise not giving full attention to identifying the presence of other persons and/or vehicles.

It is common in such facilities to see convex mirrors mounted to vertically extending surfaces, such as on fixed walls, shelving, etc. In many facilities, there may be adequate vertical mounting surfaces to which mirrors can be fixedly mounted.

Commonly, multiple mounting arms are connected between a fixed vertical support and a frame on the mirror. The mounting structure can be configured to adjustably place the convex mirror so as to optimize the usable horizontal and vertical reflective image ranges. While a convex mirror technically has the ability to reflect images over wide horizontal and vertical ranges, the mirrors are commonly strategically aligned, recognizing that only portions of the reflected horizontal and vertical ranges are large enough to be practically usable—these usable ranges being in areas closer to the center of the convex shape.

In some facilities, some, if not all, of the "critical intersections" do not have rigid structures usable to mount such safety mirrors. Operators of businesses in this category generally have two options. First, they can proceed without using mirrors and highlight critical locations as by lights, such as flashing lights or strobes, by using floor markings, etc. While these steps may reduce risk, they are effective only if persons exercise an appropriate level of care—generally requiring that persons slow down when approaching, or stop when at, a blind intersection.

Alternatively, dedicated supports may be provided for the mirrors. Typically, these dedicated supports will be in the form of a rigid base to which the mirror can be fixedly mounted. If the base is incorporated at floor level, it may provide an obstruction to workers and may interfere with traffic flow patterns. Generally, any structure added within a facility competes for usable space, which is almost always at a premium.

As noted above, in the absence of any structure for readily mounting safety mirrors, operators of such facilities have often opted to not use mirrors at different locations where they would be beneficial. These decisions are often made in the interest of controlling costs, as a result of which movements of personnel around a space may be disrupted, and in a worst case injuries may result.

The industry continues to seek out affordable and practical ways to facilitate safe and coordinated movement of personnel, on foot and in vehicles, in environments in which they navigate.

SUMMARY OF THE INVENTION

In one form, the invention is directed to a suspended mirror system including: a frame; a reflective surface on the frame; an intermediate support; a primary support configured to be connected to a mounting base so as to be in a mounting orientation wherein the primary support extends downward from a part of the mounting base and is connected to the intermediate support; at least one rigid component connecting between the frame and the intermediate support; and at least one holding component connecting between the frame and at least one of the at least one rigid component, the primary support, and the intermediate support to stabilize the frame with the frame in a desired angular relationship with the intermediate support. The frame, intermediate support, and at least one rigid component are configured so that with the primary support in the mounting orientation, an angular relationship between the frame and intermediate support can be controllably changed so as to change and maintain an angular orientation of the reflective surface to thereby allow selection of a vertically reflecting image range for the reflective surface.

In one form, the reflective surface has a convex shape.

In one form, the frame is made up of a substantially flat panel.

In one form, the primary support has first and second components that with the primary support in the mounting orientation connect to the intermediate support at spaced locations.

In one form, the primary support has first and second components that with the primary support in the mounting orientation connect to the mounting base at spaced locations.

In one form, the intermediate support is in the form of an elongate bar with a length that extends substantially horizontally with the primary support in the mounting orientation.

In one form, the frame is made up of a substantially flat panel. The at least one rigid component connects between the substantially flat panel and the elongate bar.

In one form, the at least one rigid component is connected to at least one of the substantially flat panel and the elongate bar for guided pivoting movement relative to the at least one of the substantially flat panel and the elongate bar.

In one form, the at least one rigid component has a length and is configured so that the length of the at least one rigid component can be changed.

In one form, the reflective surface is defined on a body having a cup shape with an open end. The substantially flat panel is at or adjacent the open end.

In one form, the at least one rigid component consists of first and second rigid components.

In one form, the first and second rigid components are each connected to at least one of the frame and intermediate support for guided pivoting movement relative to the at least one of the frame and intermediate support around a shared axis.

In one form, the at least one holding component is in the form of a flexible elongate component with a length that connects between the frame and intermediate support. The flexible component is configured so that an effective length of the flexible component between the frame and intermediate support can be selectively changed.

In one form, the primary support in the mounting orientation has a length and is made up of a flexible component and is configured so that an effective length of the primary support can be selectively changed.

In one form, the invention is directed to a suspended mirror system including: a frame; a convex reflective surface on the frame; and a support system connecting between a mounting base and the frame and configured so that the frame is suspended in an operative position below a part of the mounting base. The support system has at least one elongate flexible component in depending relationship with a part of the mounting base and under tension from a weight of the frame.

In one form, the support system has first and second elongate flexible components each in depending relationship with the part of the mounting base and under tension from a weight of the frame.

In one form, the at least one elongate flexible component makes up a primary support on the support system. The support system further includes an intermediate support between the frame and the primary support. The frame is configured to be controllably angularly reoriented relative to the intermediate support so as to change and maintain an angular orientation of the reflective surface to thereby change a vertically reflecting image range for the reflective surface.

In one form, the mirror system has a body with a cup shape with a convex surface on which the reflective surface is located.

In one form, the invention is directed to a method of suspending a mirror including the steps of: obtaining a body with a convex surface on which a reflective surface is defined, the body connected to a frame; suspending the frame from a mounting base using at least one flexible component between the mounting base and frame such that the at least one flexible component: a) depends from a part of the mounting base; b) suspends the frame in an operative position below the part of the mounting base; c) is under tension from a weight of the frame; and d) provides a sole weight support for the frame. With the frame in the operative position, the reflective surface reflects images in a vertically reflecting image range.

In one form, the method further includes the step of changing an orientation of the frame to thereby change the vertically reflecting image range.

BRIEF DESCRIPTION OF THE DRAWINGS

FIG. 1 is a schematic representation of a mirror of the type that can be used with the present invention:

FIG. 2 is a schematic representation of a system, according to the invention, for suspending a mirror from a mounting base;

FIG. 3 is a schematic representation of the inventive system, as in FIG. 2, and showing additional optional details of the system;

FIG. 4 is a front elevation view of one exemplary form of system as shown in FIGS. 2 and 3;

FIG. 10 is an enlarged, fragmentary view of one of the connections between components in FIG. 9;

FIG. 11 is a schematic representation of the inventive system in an initial setup stage;

FIG. 12 is a view as in FIG. 11 wherein a mirror on the system has been adjusted to a selected operative position/orientation;

FIG. 13 is a schematic representation of a connection between a holding component and separate parts of the system to maintain a selected angular orientation for the mirror; and FIG. 14 is a flow diagram representation of a method of suspending a mirror, according to the present invention.

DETAILED DESCRIPTION OF THE PREFERRED EMBODIMENT

Figure 5:
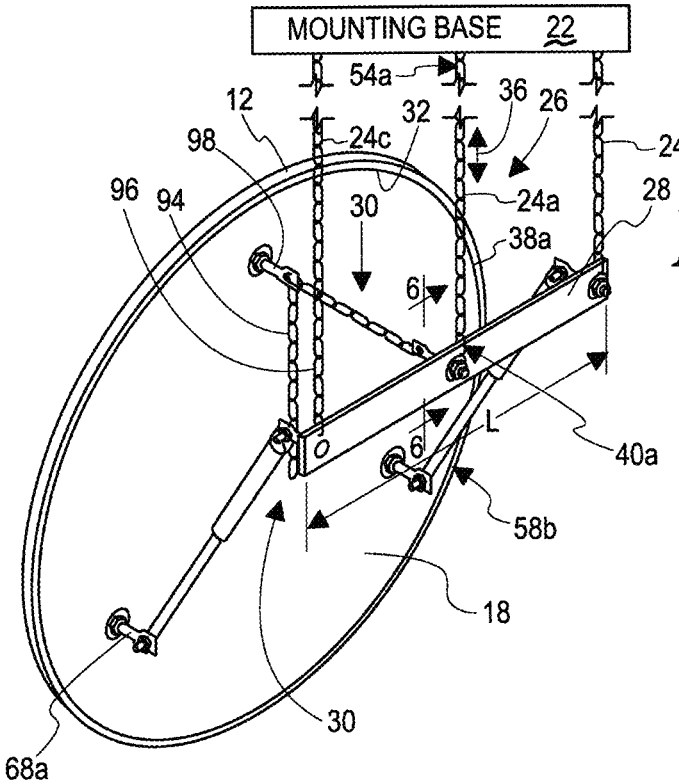
FIG. 5 is a rear perspective view of the system in FIG. 4.
Figure 7:
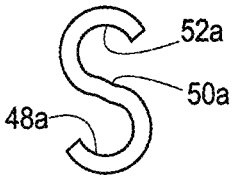
FIG. 7 is an enlarged elevation view of a connector usable between components on the system in FIGS. 4 and 5.
Figure 6:
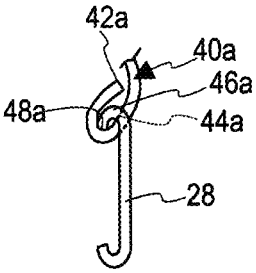
FIG. 6 is a cross-sectional view of an intermediate support on the system taken along line 6-6 of FIG. 5.

The invention is directed to a suspended mirror system without limitation as to its particular environment. A mirror, as contemplated by the invention, and shown schematically at 10 in FIG. 1, is any structure consisting of a body 12 having an exposed reflective surface 14. While not so limited, the invention is particularly suitable for, and described hereinbelow with respect to, a mirror 10 with a convex reflective surface 14. As depicted, the body 12 has a cup shape on one side of which the reflective surface 14 is present.

The precise manner in which the mirror 10 is constructed is not critical to the present invention. For example, the reflective surface 14 may be integrally formed with the body 12 as a single layer or as one of multiple layers. Alternatively, the reflective surface 14 can be separately applied to the pre-formed body 12.

The suspended mirror system, as shown schematically at 16 in FIG. 2, consists of a frame 18, on which the reflective surface 14 is supported, and a support system 20 connecting between a mounting base 22 and the frame 18 and configured so that the frame and reflective surface 14 are each suspended in an operative position below at least a part of the mounting base 22.

The support system 20 has at least one flexible component 24 that is in depending relationship with a part of the mounting base 22 and under tension from the weight of the frame 18.

In one preferred form, there are at least first and second flexible components 24 that are arranged to cooperate between the mounting base 22 and frame 18 so that the frame, while movable relative to the mounting base, is maintainable substantially in a single operative position/orientation—confined against turning principally around a vertical axis.

As shown in FIG. 3, in one form, the at least one flexible component 24 makes up at least part of a primary support 26 on the support system 20. The support system 20 further includes an intermediate support 28 between the frame 18 and primary support 26. The intermediate support 28, which is optional within the broader concept of FIG. 2, is joined to the frame 18, through connecting structure 30. The connecting structure 30 allows the frame 18 to be controllably angularly reoriented relative to the intermediate support 28 so as to change an angular orientation of the reflective surface 14 on the frame 18 to thereby change a vertically reflecting image range for the reflective surface 14.

One exemplary form of the system, as shown generically in FIGS. 2 and 3, is shown in details in FIGS. 3-13. The exemplary form in FIGS. 3-13 is not intended to be limiting, as the generic showings in FIGS. 2 and 3 are intended to encompass virtually an unlimited number of different forms of each of the components therein and their interactions.

In this embodiment, the body 12 is cup shaped with an open end 32. The body 12 has an outturned annular flange 34 at the open end 32 which defines a support for the frame 18, shown in the form of a substantially flat panel. The frame/flat panel 18 is connected to the body 12 at the flange 34. The connection may be at or adjacent to the open end 32.

The intermediate support 28 is in the form of an elongate, rigid bar with a length L that extends substantially horizontally with the primary support 26 in the mounting orientation of FIGS. 4 and 5 and the frame 18 in its operative position—connected to the intermediate support 28 through the connecting structure 30 as shown in FIGS. 4 and 5. The flat shape of the bar is selected to facilitate attachment of various connectors thereto. The rolled, parallel edges add rigidity. The intermediate support 28 may take many very different forms and still perform the functions described herein.

The primary support 26 consists of at least one flexible component 24*a* with a length indicated by the double-headed arrow 36 between a part of the mounting base 22 and the intermediate support 28. In the depicted form, the flexible component 24 is a chain with interlocked links 38*a*. It should be understood that the flexible component 24*a* is not required to be flexible along its entire length. In the depicted form, the chain configuration extends fully between the mounting base 22 and the intermediate support 28.

In the depicted form, one end 40*a* of the flexible component 24*a* is connected to the intermediate support 28 by directing a free end part 42*a* through an opening 44*a* in the intermediate support 28 to cause a part of the free end 40*a* to wrap around a portion 46*a* of the intermediate support 28. The portion 46*a* on the intermediate support 28 is thus supported by an upwardly opening U-shaped seat 48*a* at the end 40*a*. The seat 48*a* may be formed by one of the links 38*a* or by a separate component, such as on an S-hook as shown at 50*a* in FIG. 7. The lower portion of the "S" defines the seat 48*a*, whereas the upper portion of the "S" defines an oppositely opening, curved seat 52*a*, as to engage one of the links 38*a*.

The S-hook 50*a* may be deformed after assembly to provide closed loops surrounding the intermediate support portion 46*a* and a link 38*a* on the flexible component 24*a*. This is, of course, only one of many different connecting arrangements that might be utilized.

Figure 8:
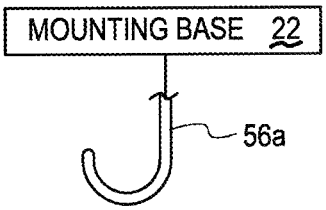
FIG. 8 is a partially schematic representation of an exemplary connector between a mounting base and a support system on the inventive system.
Figure 9:
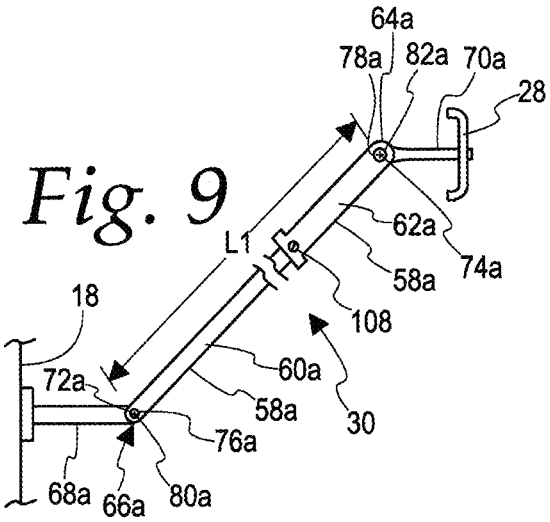
FIG. 9 is a fragmentary, side elevation view of one component on a connecting structure cooperating between the mirror and the intermediate support on the system in FIGS. 4 and 5.

The opposite/upper end 54*a* of the flexible component 24*a* can be connected to the mounting base 22 in any suitable manner. As just one example, as shown in FIG. 8, a supporting hook 56*a* may be provided on the mounting base 22 to engage one of the links 38*a*, an S-hook, such as the S-hook 50*a* in FIG. 7, or another suitable structure.

It should be understood that the flexible component 24*a* may be permanently connected to each of the intermediate support 28 and mounting base 22 or releasably, as by not deforming/crimping components, such as the S-hook 50*a*, once its ends are engaged with the system 16.

With the chain arrangement shown, the effective length of the flexible component 24*a* can be easily changed by either cutting the same or engaging different lengthwise portions thereof with the mounting base 22 and/or intermediate support 28.

The elongate flexible component 24*a* may be joined in similar fashion directly between the mounting base 22 and frame 18, in the event that the intermediate support 28 and connecting structure 30 are not utilized.

In the depicted form, two additional elongate flexible components 24*b*, 24*c* are utilized. In the exemplary form, each of the flexible components 24*a*, 24*b*, 24*c* is the same and connects between the mounting base 22 and intermediate support 28 in the same fashion, though this is not a requirement. The flexible components 24*b*, 24*c* are connected adjacent opposite lengthwise ends of the intermediate support 28 with the flexible component 24*a* midway therebetween.

The multiple flexible component construction confines twisting of the intermediate support 28 around a vertical axis relative to the mounting base 22. Thus, a consistent mounting orientation can be maintained for the primary support 26. A single flexible component, or two, or more than three, flexible components 24 might be utilized.

In the depicted form, the lengths of the flexible components 24 are substantially parallel over their full vertical lengths, though this is not a requirement.

The connecting structure 30 consists of at least one rigid component 58*a* connecting between the frame 18 and the intermediate support 28. In this embodiment, the rigid component 58*a* is made up of telescopingly engaged parts 60*a*, 62*a* that cooperatively produce an overall length L1 between opposite ends 64*a*, 66*a*.

In this embodiment, a mounting post 68*a* is fixed on the frame/flat panel 18, with a separate mounting post 70*a* fixed on the intermediate support 28. The mounting posts 68*a*, 70*a* project in cantilever fashion from the frame/flat panel 18 and the intermediate support 28 and define mounting seats 72*a*, 74*a*, respectively for pivot posts 76*a*, 78*a*. The post 76*a* guides pivoting movement of the end 66*a* relative to the post 68*a* around an axis 80*a*. The post 78*a* similarly guides pivoting movement of the end 64*a* relative to the post 78*a* around an axis 82*a*.

In the depicted form, the axes 80*a*, 82*a* are substantially parallel and horizontal with the mirror 10 in its operative position as in FIGS. 4 and 5.

In this embodiment, the connecting structure 30 consists of the rigid component 58*a* and a like, second, rigid component 58*b* which, while not required, is shown to have the same construction as the rigid component 58*a* and is connected to the frame/flat panel 18 and intermediate support 28 in like fashion. The additional rigid component 58 is desired to provide a stronger and more stable mount for the frame 18.

In one exemplary form, the connections between the ends 64*a*, 66*a* and the respective mounting posts 68*a*, 78*a* are the same, though this is not a requirement. As shown in FIG. 10, the exemplary pivot post 76*a* is defined by a bolt 84*a* which is directed through the mounting post 68*a* and the part 60*a* on the rigid component 58*a* to define the pivot axis 80*a*. A threaded shank 86*a* on the bolt 84*a* accepts a nut 88*a*. With the nut 88*a* loosened, the part 60*a* is free to pivot about the axis 80*a* relative to the mounting post 68*a*.

By tightening the nut 88*a*, a relative angular position of the part 60*a* and mounting post 68*a* can be fixed. Lock washers 90 may be used to provide more positive fastening.

As noted above, the pivot connection at both ends 64*a*, 66*a* can be established using the same structure, which is also usable, but not required, in connecting the rigid component 58*b*.

As depicted, the components 58*a*, 58*b* have ends that pivot around axes shared by the rigid components 58*a*, 58*b*.

In FIG. 11, a schematic representation is shown of the components described above to make up the system 16, with the primary support 26 connected to the mounting base 22 and in a mounting orientation, wherein the flexible components 24 extend downward from the mounting base and are connected to the intermediate support 28. The intermediate support 28 is in turn connected to the frame/flat panel 18 on the mirror 10 through the rigid components 58 on the connecting structure 30.

The precise orientations of all the components between the mounting base 22 and the mirror 10 in FIG. 11 are dictated by their dimensions, weight, and points of connection. As depicted, the flexible component(s) 24 is/are put under tension by the weight of the mirror 10 suspended therefrom. The weight of the mirror 10 also pivots the rigid component(s) 58 on the connecting structure 30 so that the length of each connecting component 58 is substantially vertically aligned.

The mounting post 68*a* is diametrically off-center so that the mirror 10 pivots under its own weight around the axis 80*a* in the direction of the arrow 92, generally to the operative orientation as shown in FIG. 11.

The frame 18, intermediate support 28, and at least one rigid component 58 are configured so that with the primary support 26 in the mounting orientation, an angular relationship between the frame 18 and intermediate support 28 can be controllably changed so as to change and maintain an angular orientation of the reflective surface 14 to thereby selectively change a vertically reflecting image range for the reflective surface 14. The angular orientation of the intermediate support 28 around its length may actually change somewhat as the mirror 10 is pivoted and its weight is distributed differently—however, this pivoting movement will be treated herein as negligible.

At setup, the mirror 10 may be allowed to pivot under its weight to the FIG. 11 position. Alternatively, this pivoting movement can be confined by at least one holding component, shown schematically at 94 in FIG. 11, that is part of the connecting structure 30 and connects between the frame 18 and at least one of the at least one rigid component 58, the primary support 26, and the intermediate support 28, to stabilize the frame 18 with the frame in a desired angular relationship with the intermediate support 28.

In the depicted form, the at least one holding component 94 is a flexible component, in this embodiment in the form of a chain with links 96 making up part or all of its length. The holding component 94 in this form cooperates between connectors 98, 100, respectively on the frame 18 and intermediate support 28 and making up part of the connecting structure 30.

Starting with the system 16 in the FIG. 11 state, the mirror 10 can be pivoted around the axis 80*a* in the direction of the arrow 102, generally to the FIG. 12 position. Depending upon the degree of pivoting around the axis 80*a*, the vertically reflecting image range is effectively changed. As noted previously, only a portion of the reflected image on the reflective surface is discernible adequately to be practically usable for its intended purpose. The desired angular position of the mirror 10, determined by the angular relationship between the frame 18 and the intermediate support 28, is maintained by engaging the at least one holding component 94 between the connectors 98, 100.

As shown in FIG. 13, connectors 104, 106, on the holding component 94, and respectively cooperating with the connector 98 and connector 100, may take an unlimited number of different forms, which are encompassed by the generic showing in FIG. 13.

For example, with the holding component 94 in the form of the chain shown, each of the links 96 may function as a connector. For example, the connector 100 may have a hooked arrangement such as an S-hook to engage a link 96. The connector 98 may have a like configuration. The holding component 94 might be fixedly connected to one of the connectors 98, 100, and releasably connected to the other to allow for effective length adjustment of the holding element 94 and thereby selection of a different angular relationship of the mirror 10 relative to the support system 20 and components thereon. Alternatively, all connectors may be releasably engageable to facilitate selection and maintenance of different angular positions of the mirror 10.

With the basic concepts described above, virtually an unlimited number of variations can be made as to allow different relative movement between the components, different angular relationships of the mirror 10, different positions of the mirror 10 relative to other components, etc.

For example, the length L1 of the rigid component 58*a* may be changed by loosening a fastener 108 and relatively translating the telescopingly engaged parts 60*a*, 62*a*. When a desired length L1 is established, the fastener 108 can be tightened to maintain the selected length L1. As seen in FIG. 11, the length of the component 58 dictates the arcuate path of the mirror 10 as it is pivoted from the FIG. 11 position towards or past the FIG. 12 position.

The suspension mounting of the mirror 10 allows for the mirror 10 to be strategically placed and oriented with solely an overhead mounting base 22. That is, the mounting base 22 may be on a ceiling, defined by a cantilevered arm, etc. Height and angular orientation of the mirror 10 can be readily accomplished. While support of the mirror 10 by structure in addition to the primary support 26 is contemplated, the absence of such supplemental support simplifies the overall system and use thereof.

Further, the ability to connect and disconnect parts facilitates assembly, disassembly, and adjustment. Permanent connection of parts can be selected for safety reasons.

Once a desired viewing angle has been selected and established using the at least one holding component 94, the connections at all ends of the rigid component(s) 58 can be firmly fixed by tightening fasteners such as the bolt 84 and nut 88 in FIG. 10.

With the structure described above, a method of suspending a mirror can be performed as shown in flow diagram form in FIG. 13.

As shown at block 120, a body is obtained with a convex surface on which a reflective surface is located. The body is connected to a frame.

As shown at block 122, the frame is suspended from a mounting base using at least one flexible component between the mounting base and frame such that the at least one flexible component: a) depends from the mounting base;

b) suspends the frame in an operative position below a part of the mounting base; c) is under tension from a weight of the frame; and d) provides a sole required weight support for the frame, whereby the body can be repositioned relative to the mounting base by reconfiguring the at least one flexible component.

With the frame in the operative position, the reflective surface reflects images in a vertically reflecting image range.

Optionally, as shown at block 124, the orientation of the frame may be changed to thereby change the vertically reflecting image range.

The foregoing disclosure of specific embodiments is intended to be illustrative of the broad concepts comprehended by the invention.

The invention claimed is:

1. A suspended mirror system comprising:

a frame;

a reflective surface on the frame;

an intermediate support;

a primary support configured to be connected to a mounting base so as to be in a mounting orientation wherein the primary support: (i) is configured to extend downward from a part of the mounting base; and (ii) is connected to the intermediate support;

at least one rigid component connecting between the frame and the intermediate support, the at least one rigid component connected for pivoting movement relative to: a) the frame around only a single fixed axis; and b) the intermediate support around only a single fixed axis, the frame, the intermediate support, and the at least one rigid component configured so that with the primary support in the mounting orientation an angular relationship between the frame and the intermediate support can be controllably changed so as to change and maintain an angular orientation of the reflective surface; and at least one holding component connecting between the frame and at least one of: (a) the at least one rigid component; (b) the primary support; or (c) the intermediate support to stabilize the frame with the frame in a desired angular relationship with the intermediate support so that the reflective surface on the frame reflects desired images in a space within which the suspended mirror system is placed.

2. The suspended mirror system according to claim 1 wherein the reflective surface has a convex shape.

3. The suspended mirror system according to claim 1 wherein the frame comprises a substantially flat panel.

4. The suspended mirror system according to claim 3 wherein the reflective surface is defined on a body having a cup shape with an open end and the substantially flat panel is at or adjacent the open end.

5. The suspended mirror system according to claim 1 wherein the primary support comprises first and second components that with the primary support in the mounting orientation connect to the intermediate support at spaced locations.

6. The suspended mirror system according to claim 1 wherein the primary support comprises first and second components that with the primary support in the mounting orientation are configured to connect to the mounting base at spaced locations.

7. The suspended mirror system according to claim 1 wherein the intermediate support comprises an elongate bar with a length that extends substantially horizontally with the primary support in the mounting orientation, a portion of the primary support defining an upwardly opening curved seat that receives a part of the elongate bar.

8. The suspended mirror system according to claim 7 wherein the frame comprises a substantially flat panel and the at least one rigid component is elongate and connects between the substantially flat panel and the elongate bar.

9. The suspended mirror system according to claim 8 wherein the at least one rigid component is connected to a component projecting away from the substantially flat panel for guided pivoting movement relative to the component projecting away from the substantially flat panel.

10. The suspended mirror system according to claim 1 wherein the at least one rigid component has a length and is configured so that the length of the at least one rigid component can be changed.

11. The suspended mirror system according to claim 1 wherein the at least one rigid component comprises first and second rigid components.

12. The suspended mirror system according to claim 11 wherein the first and second rigid components are each connected to the intermediate support for guided pivoting movement relative to the intermediate support around a shared axis.

13. The suspended mirror system according to claim 1 wherein the primary support in the mounting orientation has a length and comprises an elongate flexible component and is configured so that an effective length of the primary support can be selectively changed and maintained.

14. The suspended mirror system according to claim 1 wherein the primary support comprises at least three elongate flexible components.

15. The suspended mirror system according to claim 14 wherein each of the at least three elongate flexible components comprises a chain with interlocked links.

16. The suspended mirror system according to claim 14 wherein the suspended mirror system is configured so that the at least three elongate flexible components provide a sole weight support for the suspended mirror system from the mounting base with the primary support in the mounting orientation.

17. A suspended mirror system comprising:

a frame;

a reflective surface on the frame;

an intermediate support;

a primary support configured to be connected to a mounting base so as to be in a mounting orientation wherein the primary support: (i) is configured to extend downward from a part of the mounting base; and (ii) is connected to the intermediate support;

at least one rigid component connecting between the frame and the intermediate support, the at least one rigid component connected for pivoting movement relative to each of the frame and the intermediate support, the frame, the intermediate support, and the at least one rigid component configured so that with the primary support in the mounting orientation an angular relationship between the frame and the intermediate support can be controllably changed so as to change and maintain an angular orientation of the reflective surface; and at least one holding component connecting between the frame and at least one of: (a) the at least one rigid component; (b) the primary support; or (c) the intermediate support to stabilize the frame with the frame in a desired angular relationship with the intermediate support so that the reflective surface on the frame reflects desired images in a space within which the suspended mirror system is placed, wherein the at least one holding component comprises a flexible elongate component with a length that connects between the frame and the intermediate support, the flexible elongate component configured so that an effective length of the flexible elongate component between the frame and the intermediate support can be selectively changed.

* * * * *